US008251272B2

(12) United States Patent
Sugihara

(10) Patent No.: US 8,251,272 B2
(45) Date of Patent: Aug. 28, 2012

(54) STAPLER

(75) Inventor: Shinpei Sugihara, Chuo-ku (JP)

(73) Assignee: Max Co., Ltd., Chuo-ku, Tokyo (JP)

( * ) Notice: Subject to any disclaimer, the term of this patent is extended or adjusted under 35 U.S.C. 154(b) by 109 days.

(21) Appl. No.: 12/767,282

(22) Filed: Apr. 26, 2010

(65) Prior Publication Data

US 2010/0270353 A1 Oct. 28, 2010

(30) Foreign Application Priority Data

Apr. 27, 2009 (JP) ..... P. 2009-108271

(51) Int. Cl.
*B25C 7/00* (2006.01)

(52) U.S. Cl. ..... 227/87; 227/91

(58) Field of Classification Search ..... 227/7, 82, 227/87, 88, 91, 155, 85
See application file for complete search history.

(56) References Cited

U.S. PATENT DOCUMENTS 4,623,082 A 11/1986 Kurosawa
5,794,833 A * 8/1998 Str.ang..ang.t ..... 227/137
6,986,449 B2 * 1/2006 Straat et al. ..... 227/87
7,243,830 B2 * 7/2007 Kitamura et al. ..... 227/82
7,559,448 B2 * 7/2009 Kanai et al. ..... 227/120

FOREIGN PATENT DOCUMENTS

EP 0 637 487 A1 2/1995
EP 1 769 888 A1 4/2007
JP 2004-306538 11/2004

* cited by examiner

*Primary Examiner* — Rinaldi Rada
*Assistant Examiner* — Nathaniel Chukwurah
(74) *Attorney, Agent, or Firm* — Drinker Biddle & Reath LLP

(57) ABSTRACT

A stapler is provided with: a forming plate (2) configured to form a straight staple (S) into U-shape; a pusher (11) configured to push the formed U-shape staple (S1) in a first direction (Df) toward a driving portion (15); a driver plate (1) configured to drive the staple (S1) within the driving portion (15) toward sheets of paper (P); an engaging portion (27) formed on the forming plate (2); and a receiving portion (20) formed on the pusher (11). The engage portion (27) is configured to engage with the receiving portion (20), during a driving operation of the driver plate (1), so as to prevent the pusher (11) from moving in a second direction (Dr) which is opposite to the first direction (Df).

1 Claim, 9 Drawing Sheets

STAPLER

BACKGROUND OF THE INVENTION

1. Field of the Invention

The present invention relates to a stapler in which a pusher for pressing a staple is fixed when a driver plate drives the staple toward sheets of paper, thereby reliably driving the staple into the sheets.

2. Background Art

In order to enhance a binding capability of a stapler, generally, it is important to guide both leg portions of a staple so as to be neither inclined longitudinally nor opened transversely when a driver plate drives the staple. The reason is that a buckle occurs when the both leg portions are inclined or bent longitudinally or transversely. For this reason, conventionally, a guide groove is formed in a back side of a face plate so that a U-shape staple is fitted in the guide groove and the both leg portions of the staple are guided so as to be neither inclined in a forward direction nor opened transversely. A guiding operation for preventing the both leg portions of the staple from being inclined backward is carried out by means of a pusher for pushing the staple toward the face plate which is provided in a forward part. The pusher always pushes the staple toward the face plate side by means of a spring. Therefore, the staple is guided so as not to be inclined backward by a force of the spring.

In an electric stapler including a forming plate for forming a straight staple into U-shape, a pusher for pushing the formed U-shape staple toward a driving portion, and a driver plate for driving the staple toward sheets of paper, the U-shaped staple formed by the forming plate is pushed out from a back side by means of the pusher and is thus fitted in a guide groove of a face plate, and both leg portions of the staple are guided to stick at a right angle with respect to a surface of the sheets when the staple is driven out by the driver plate.

Further, the conventional stapler is disclosed, for example, in JP-A-2004-306538.

However, the pusher for guiding a rear part of the staple which is being driven in serves to press and guide the staple by a spring force. If a force for inclining the staple backward is great, therefore, the pusher tends to be moved backward against the spring force. For this reason, a spring load for pushing the pusher in a forward direction is to be increased in order to reliably carry out the guiding operation. If the spring load is increased, however, resistances of the forming plate and the pusher are increased, resulting in a forming failure. For this reason, the spring load cannot be increased. Thus, the pusher is moved away to cause a buckle in some cases.

SUMMARY OF THE INVENTION

One or more embodiments of the invention provide a stapler capable of holding a pusher in a predetermined position so as not to be moved backward during driving a staple.

In accordance with one or more embodiments of the invention, a stapler is provided with: a forming plate 2 configured to form a straight staple S into U-shape; a pusher 11 configured to push the formed U-shape staple S1 in a first direction Df toward a driving portion 15; a driver plate 1 configured to drive the staple 51 within the driving portion 15 toward sheets of paper P; an engaging portion 27 formed on the forming plate 2; and a receiving portion 20 formed on the pusher 11. The engage portion 27 is configured to engage with the receiving portion 20, during a driving operation of the driver plate 1, so as to prevent the pusher 11 from moving in a second direction Dr which is opposite to the first direction Df.

The engaging portion for being engaged with the receiving portion of the pusher pushing the formed U-shape staple toward the driving portion to prevent the pusher from being moved toward the opposite side to the push-out in the operation is formed on both sides of the forming plate, and the forming plate is then operated so that the staple is formed. The formed U-shape staple is moved forward by means of the pusher and is exactly held in a forward part. At the same time, the forming plate is moved downward so that the engaging portion of the forming plate is engaged with the receiving portion of the pusher.

When the driver plate is driven, an upper part of the U-shape staple is hit. Consequently, the staple is guided and driven toward the sheets. Front parts and outer side parts of the both leg portions are guided by a back face of a face plate and a fixed surface such as both side pieces of the forming plate, and furthermore, rear parts thereof are guided by the pusher. The pusher is usually energized simply by means of a spring. However, the forming plate is moved downward so that the engaging portion of the forming plate is engaged with the receiving portion. Consequently, the pusher cannot be moved backward any more. Even if a force acts in such a manner that the leg portion of the staple is inclined rearward to push down the pusher rearward by a greater force than a spring force when the driver plate drives the staple out, therefore, the pusher is prevented from being moved backward (moved toward the opposite side to the push-out) by the engaging portion. Thus, the rear part of the staple is also guided reliably. Accordingly, it is possible to successfully prevent a drive-in failure from being caused.

In the above structure, the engaging portion 27 may include a first inclined surface 28, the receiving portion 20 may include a second inclined surface 20*a* formed in the pusher 11 at a side of the second direction Dr. By engaging the first inclined surface 28 with the second inclined surface 20*a*, the pusher 11 may be prevented from moving to the second direction Dr.

In the above structure, the driver plate 1 may be movable in a third direction Dd perpendicular to the first direction Df to drive the stapler S1 toward the sheets P, the second inclined surface 20*a* may provided with a flat surface inclined toward the third direction Dd along the second direction Dr, and the first inclined surface 28 may be parallel to the second inclined surface 20*a*.

The engaging portion of the forming plate and the receiving portion of the pusher to be engaged with the engaging portion are inclined to each other, and the engaging portion of the forming plate carries out pressing in engagement with the back face. Therefore, the engaging portion and the receiving portion are reliably engaged with each other even if a slight error is made. Thus, the leg portion of the staple can be prevented from being inclined rearward.

DETAILED DESCRIPTION OF THE EXEMPLARY EMBODIMENTS

Figure 1:
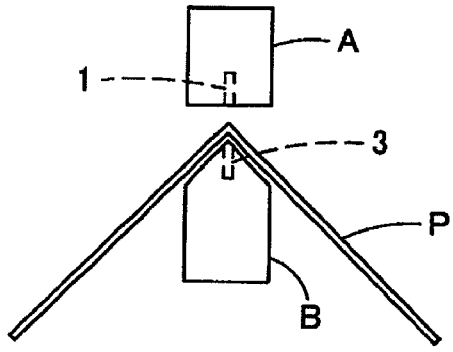
FIG. 1 is a typical view showing a stapler.

FIG. 1 is a typical view showing a stapler according to an exemplary embodiment of the invention. The stapler is formed by vertically disposing a drive-out device A including a driver plate (drive-out means) for driving a staple out and a clinching device B including a clincher mechanism 3 for bending a staple S which is driven out. Sheets of paper to be bound P, for example, a booklet or a catalog is disposed between the drive-out device A and the clinching device B and a staple is driven into a center of the sheets P by a driver plate 1 of the drive-out device A driven by an electric motor, and both leg portions of the staple penetrating through the sheets P are bent by the clincher mechanism 3 to bind the sheets P.

Figure 5A:
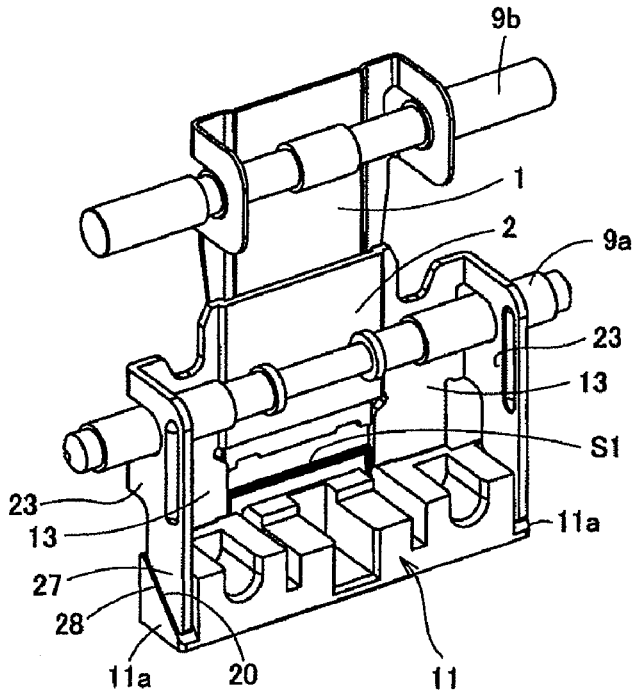
FIGS. 5A and 5B are perspective views showing an assembling state of a driver plate, a forming plate and a pusher.
Figure 5B:
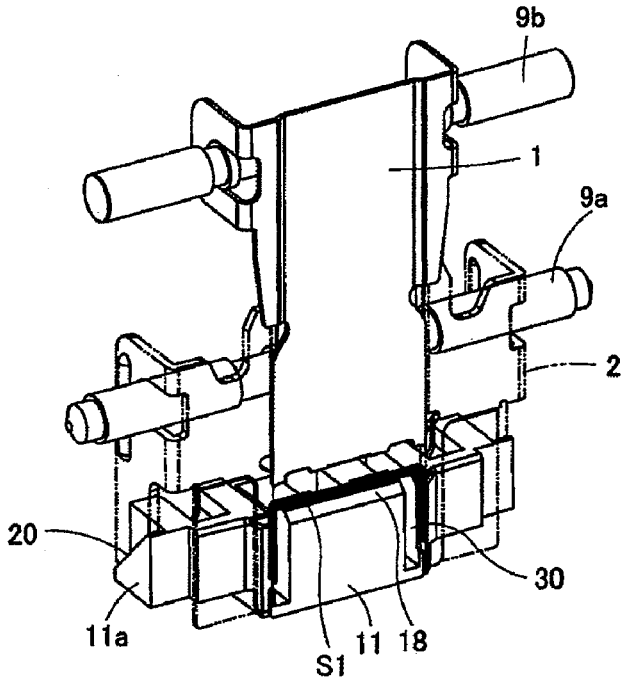
Figure 6:
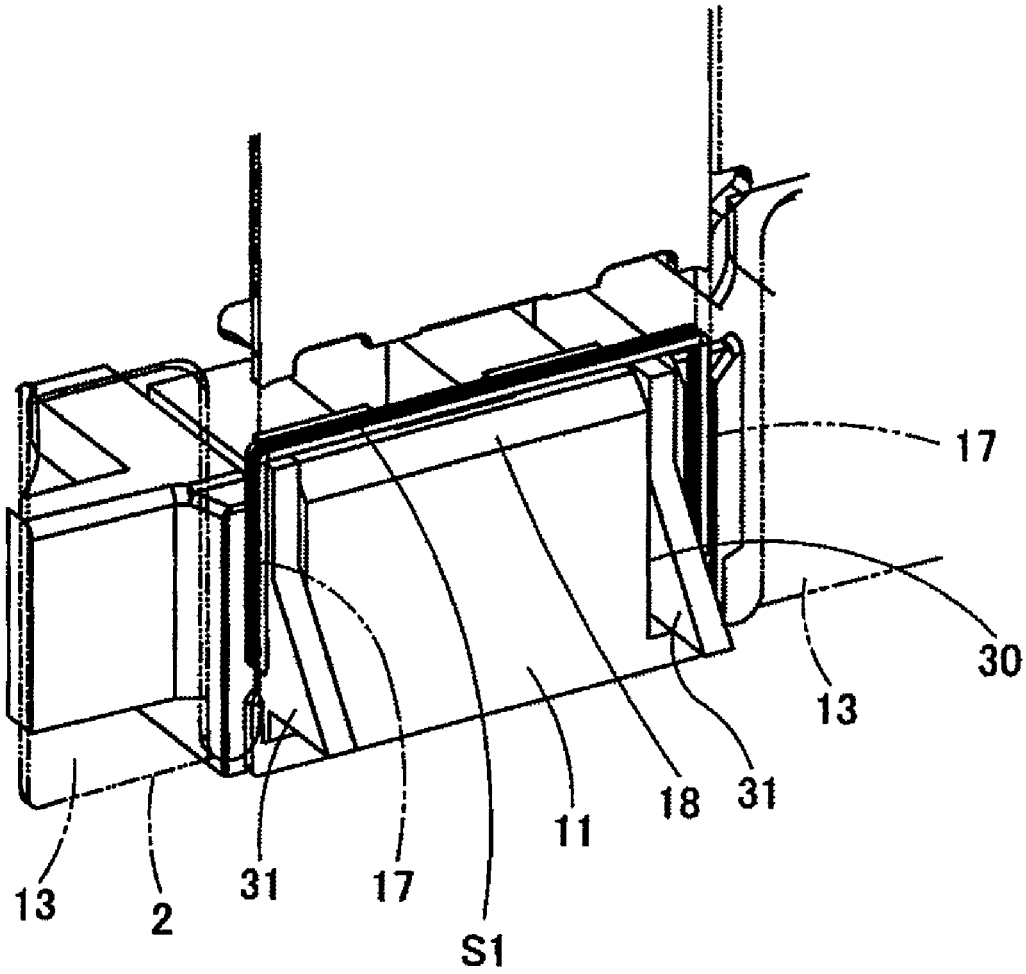
FIG. 6 is an enlarged perspective view showing a guide state of a head staple.
Figure 7:
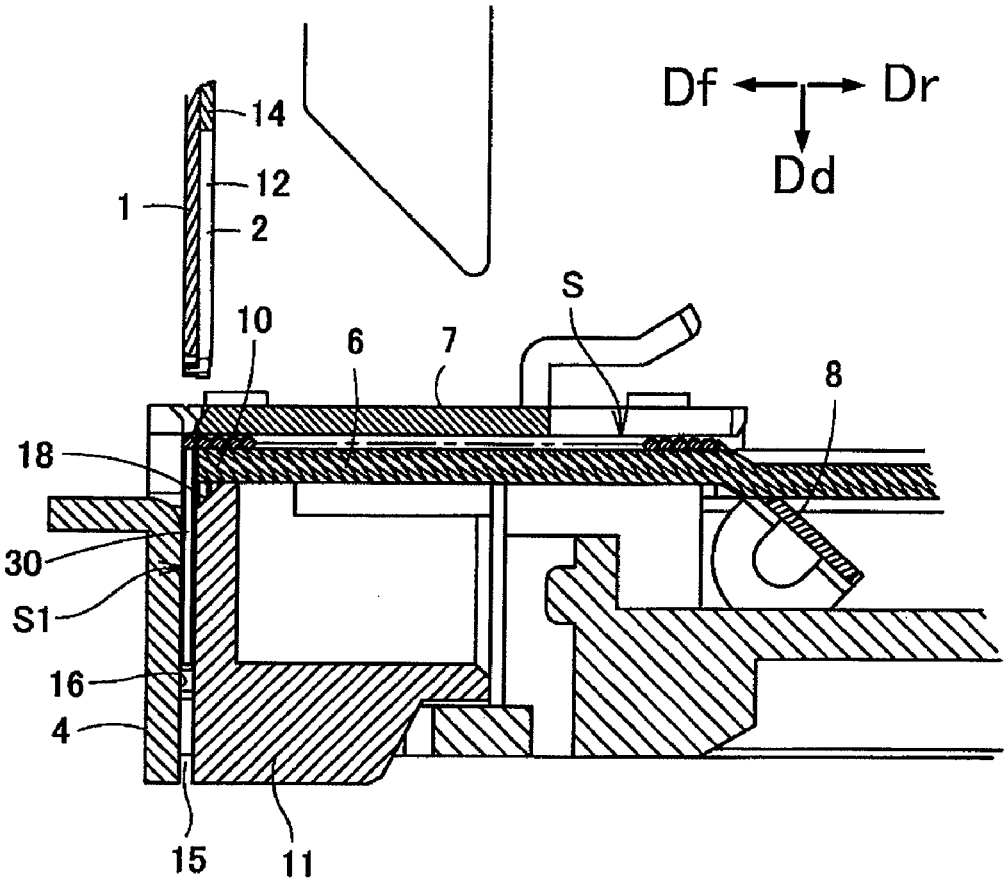
FIG. 7 is a longitudinal sectional view showing the main part of the drive-out device.

The drive-out device A has a structure in which a forming plate 2 and the driver plate 1 are stacked and disposed on a back side of a face plate 4 in a front part as shown in FIGS. 2 to 7, and the sheet-shaped staple S obtained by coupling straight staples like a sheet is fed toward the face plate 4 side in the front part by feeding means 8 along a part between a plate-shaped staple guide 6 and a staple guide presser 7 which are vertically provided orthogonally to an operating direction of the forming plate 2 and the driver plate 1 as shown in FIG. 7, the forming plate 2 is first operated downward to form a straight staple into U-shape, a head staple disposed in such a manner that both side portions are provided to be protruded over an anvil 10 overhung and formed to take a convex shape in a tip part of the staple guide 6, the formed U-shape staple is pushed forward by the feeding means 8 and a pusher 11 and is thus caused to abut on the back face of the face plate 4, and the driver plate 1 is then operated downward to drive a head staple S1 toward the sheets in a lower part (which is not shown). The sheet-shaped staple S is accommodated in a magazine portion 9 (see FIG. 2).

Figure 4:
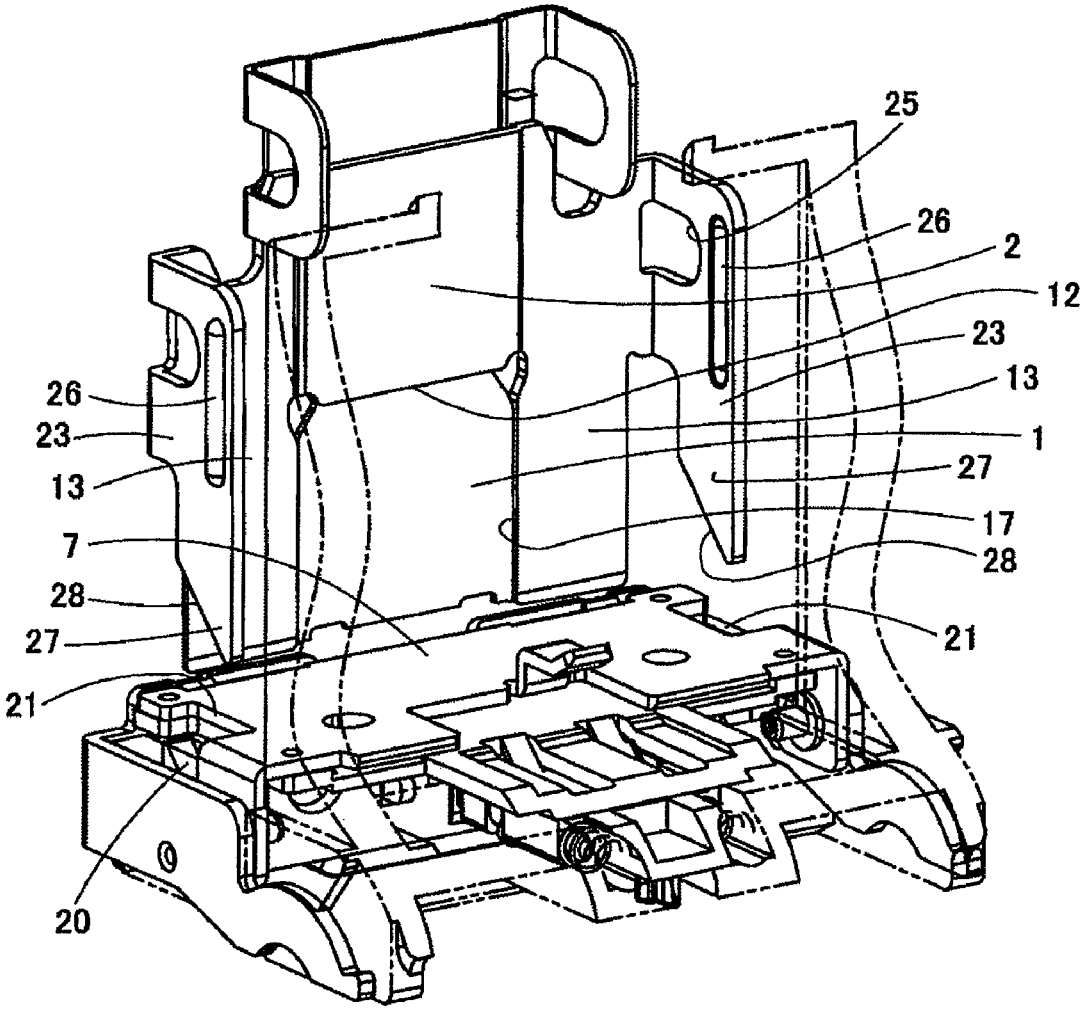
FIG. 4 is a perspective view showing a main part of the drive-out device seen from a back side.
Figure 9:
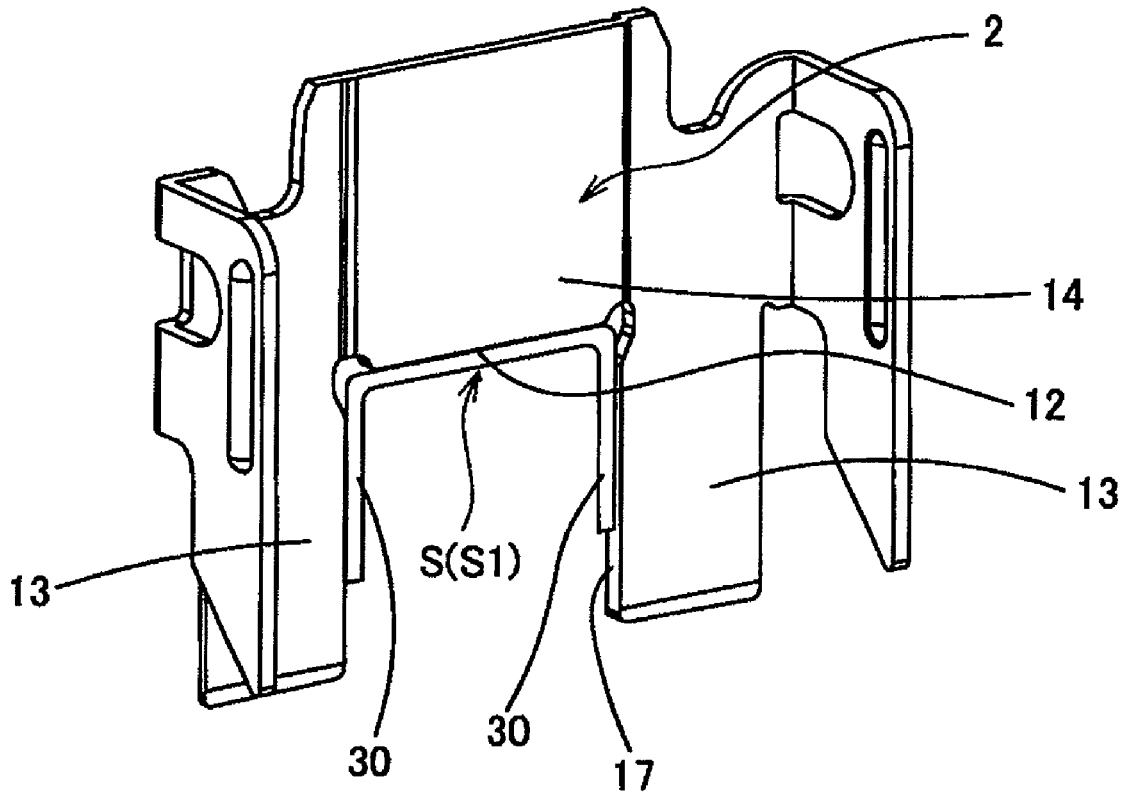
FIG. 9 is a perspective view showing a state in which a staple is formed and held by the forming plate.
Figure 11:
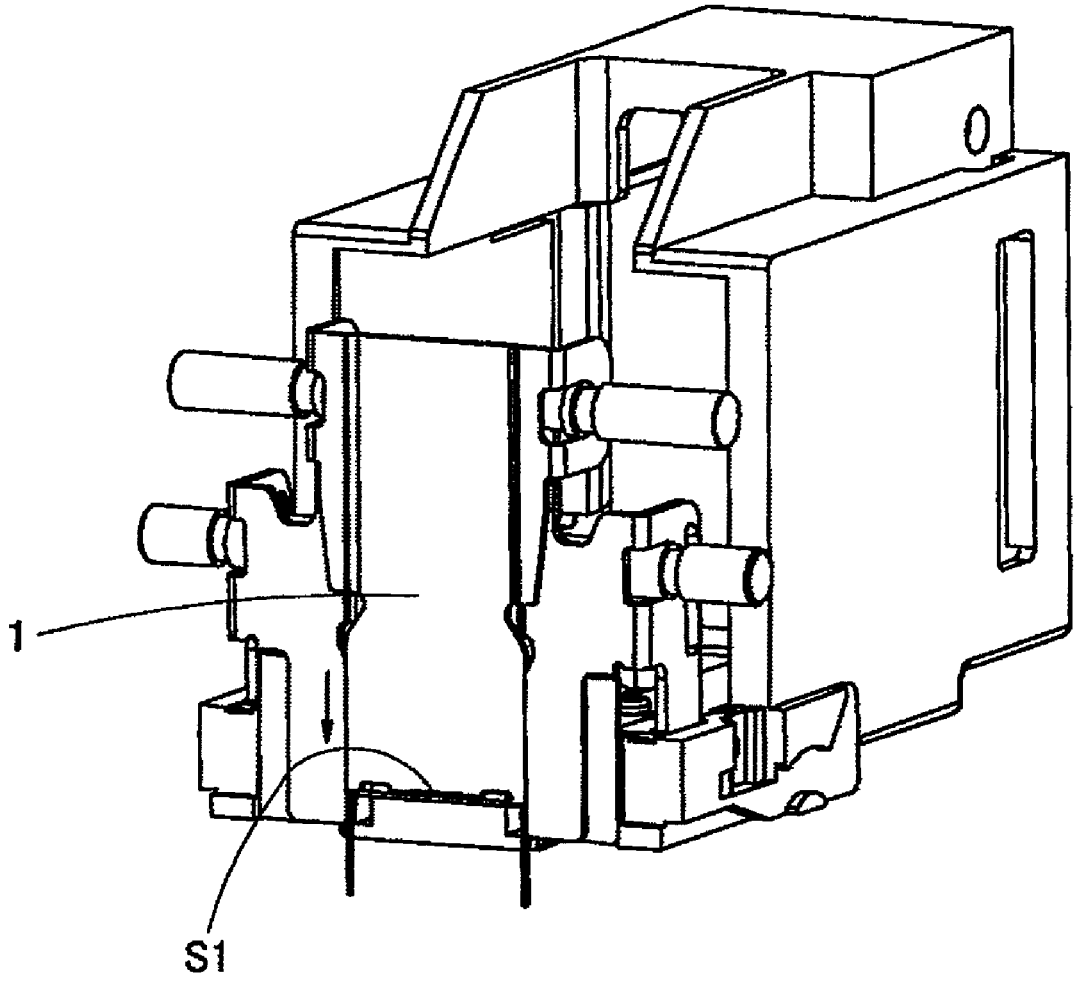
FIG. 11 is a perspective view showing a state in which a staple is driven out by means of the driver plate.

As shown in FIGS. 4 and 9, a lower part of the forming plate 2 takes a concave shape which is opened downward, and thicknesses of side pieces 13 in both side parts of a concave opening portion 12 and an upper portion 14 are set to be almost equal to a thickness of the staple S. Moreover, the driver plate 1 is disposed to slide along a front surface of the upper portion 14 of the concave opening portion 12. Therefore, the driver plate 1 can drive only the head staple S1 out as shown in FIG. 11. After the formation and before the drive-out, the head staple S1 is engaged with internal surfaces 17 of the both side pieces 13 of the concave opening portion 12 in the forming plate 2. If the thicknesses of the upper portion 14 of the forming plate 2 and the side piece 13 are set to be equal to a thickness corresponding to the number of staples to be formed, it is possible to form the same number of staples at a time.

The forming plate 2 and the driver plate 1 are coupled to driving rods 9*a* and 9*b* which are different from each other, respectively, and the driver plate 1 is operated subsequently to the forming plate 2.

Figure 2:
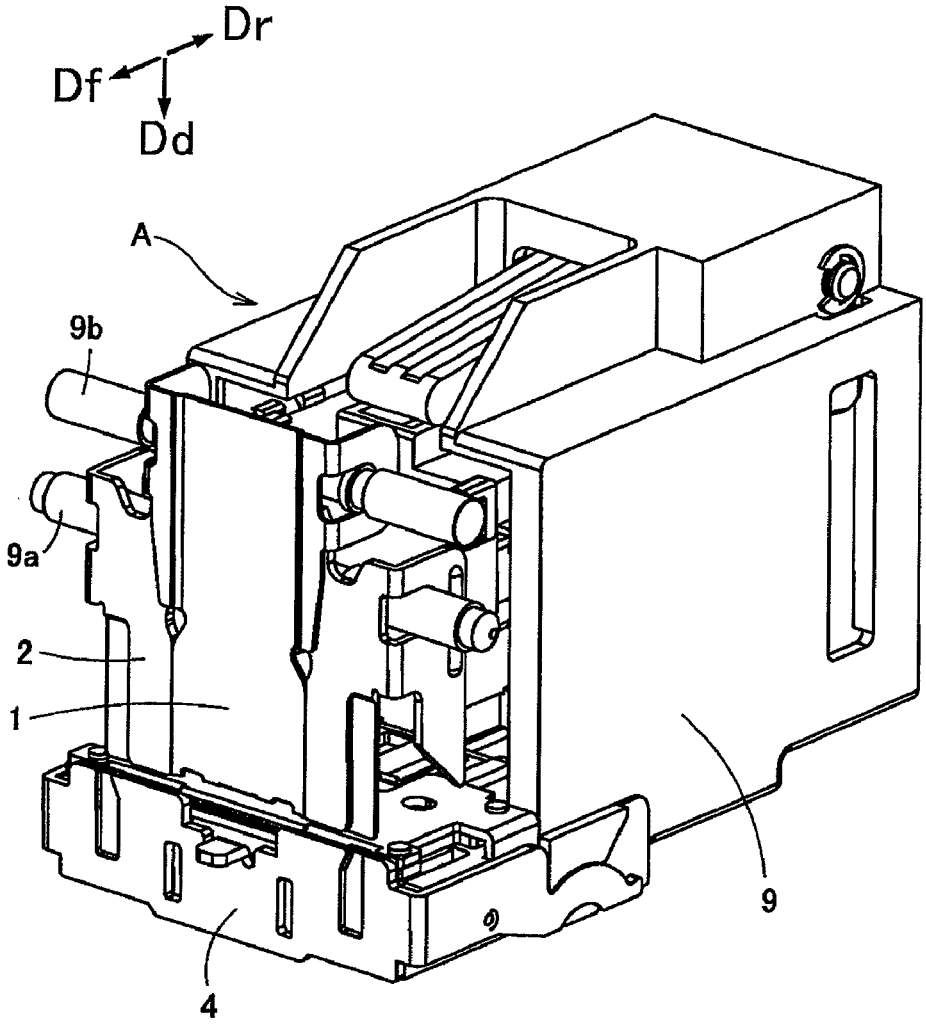
FIG. 2 is a perspective view showing a drive-out device for the stapler.
Figure 8:
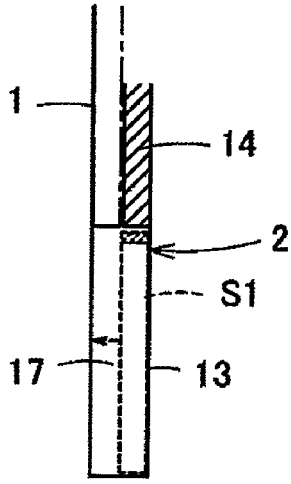
FIG. 8 is a longitudinal sectional view showing a positional relationship between the driver plate and the forming plate.

As described above, after the head staple S1 is driven out by the driver plate 1, the U-shape staple formed by the forming plate 2 is fed forward corresponding to a single staple by the feeding means 8 and the pusher 11, the head staple S1 abuts on the back face of the face plate 4 and a lower part thereof faces a driving portion 15 as shown in FIGS. 7 and 8. In a state in which the forming plate 2 is held in a position of a bottom head center, front faces of two staples are guided by a back face 16 of the face plate 4 as shown in FIGS. 2 and 7 and outer side surfaces of the staple are supported on the internal surfaces 17 of the both side pieces 13 in the forming plate 2 as shown in FIG. 6. Moreover, inner side surfaces of the head staple S1 are supported on inside guides 31 accommodated in grooves 30 at both sides of the pusher 11 and provided to appear frequency from a front surface of the pusher 11 as shown in FIG. 6. The inside guide 31 is always energized forward by means of a spring and a tip is engaged with the back face of the face plate 4.

Figure 10A:
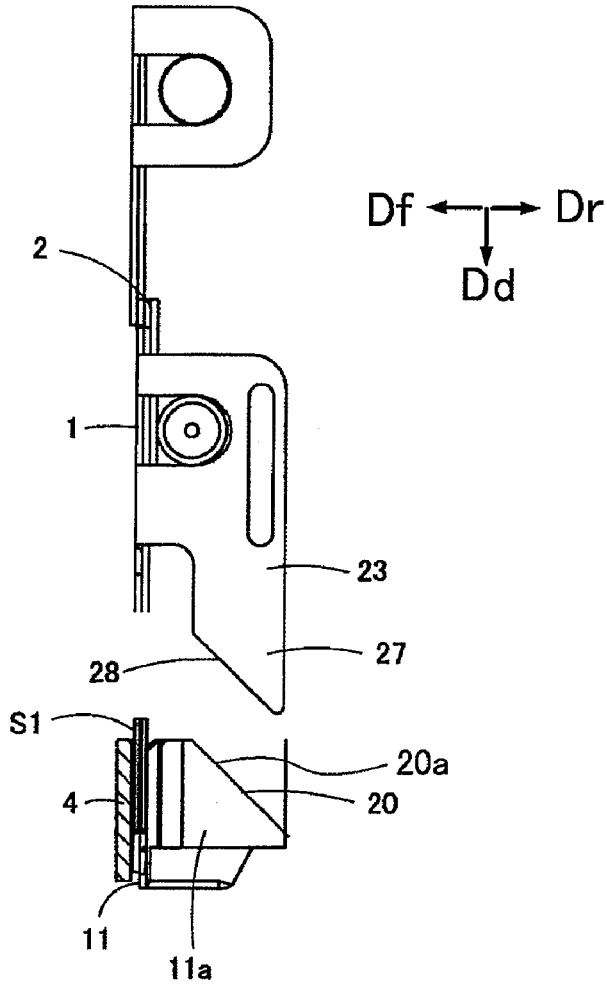
FIGS. 10A and 10B are sectional views showing a configuration in which the forming plate is engaged with the pusher.

The pusher 11 is disposed to be longitudinally slidable below the staple guide 6 and is always energized forward (in a first direction Df) by means of a spring (not shown). Furthermore, an inclined surface is formed on an upper end 18 in a front part of the pusher 11 as shown in FIGS. 5B and 6. Receiving portions 20 on rear ends of triangular blocks 11*a* at both sides are inclined to be lowered rearward as shown in FIGS. 5A, 5B and 10A so as to define second inclination surfaces 20*a*. That is, the second inclined surface 20*a* is defined by a flat surface inclined toward a lower side (a third direction Dd) along the second direction Dr. The staple guide presser 7 for guiding an upper surface of the sheet-shaped staple is disposed above the pusher 11, and a notch portion 21 is formed in a corresponding part to the receiving portion 20 of the pusher 11 at both sides of the staple guide presser 7 as shown in FIG. 4.

Corresponding to the pusher structure, there are formed blade pieces 23 (see FIG. 4) which are bent rearward at an almost right angle from an outside of the both side pieces 13 of the forming plate 2. An engaging hole 25 for an engagement with a driving rod 24 and a guide hole 26 for guiding the forming plate 2 in a vertical direction are formed on the blade piece 23. A wedge-shaped engaging piece (engaging portion) 27 is formed on a lower part of the blade piece 23 so as to be protruded downward and is disposed in a corresponding position to the notch portion 21 of the staple guide presser 7. A front and lower part of the engaging piece 27 is inclined so that an inclined surface 28 (a first inclined surface 28) is formed. The first inclined surface 28 may be parallel to the second inclined surface 20*a*.

Figure 3:
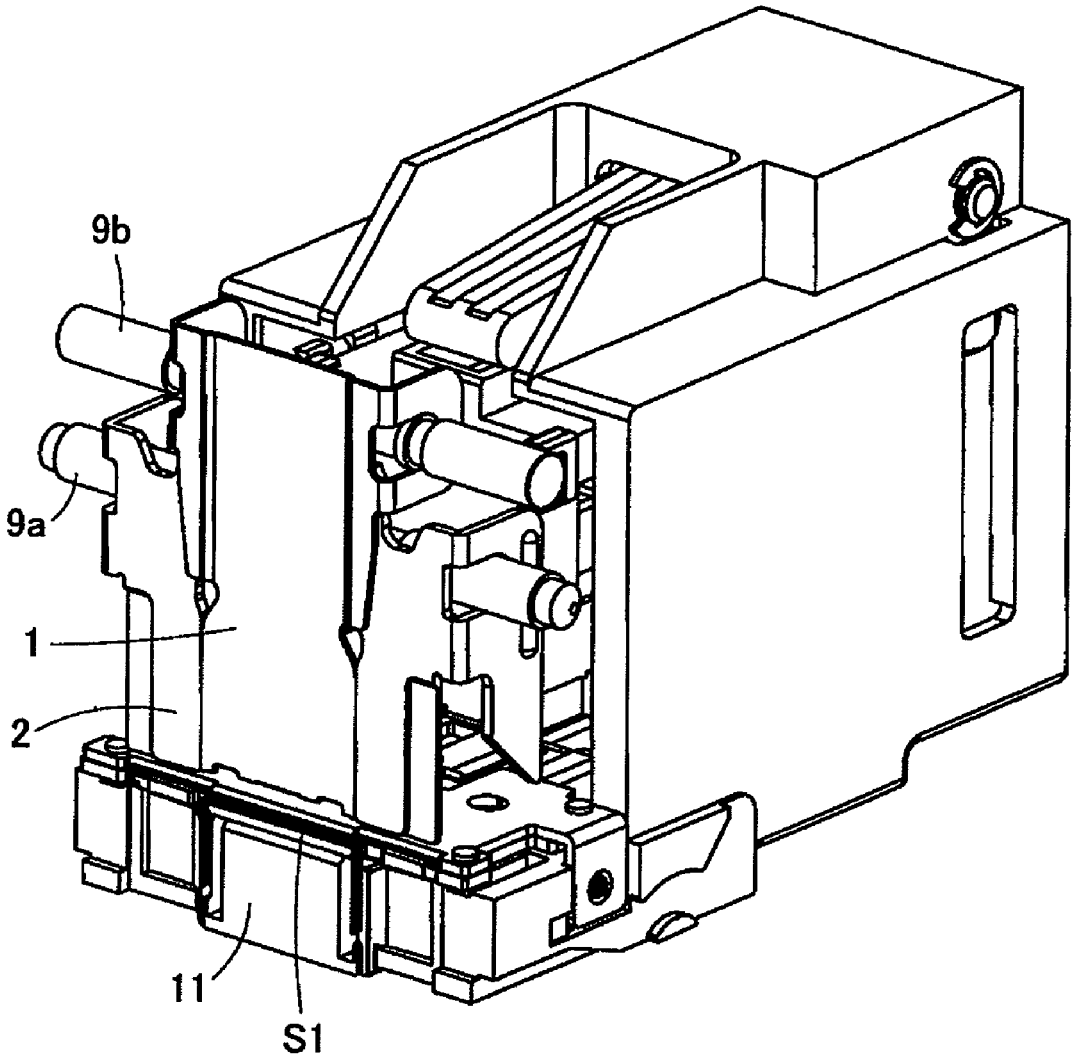
FIG. 3 is a perspective view showing a state in which a face plate is removed from the drive-out device.
Figure 10B:
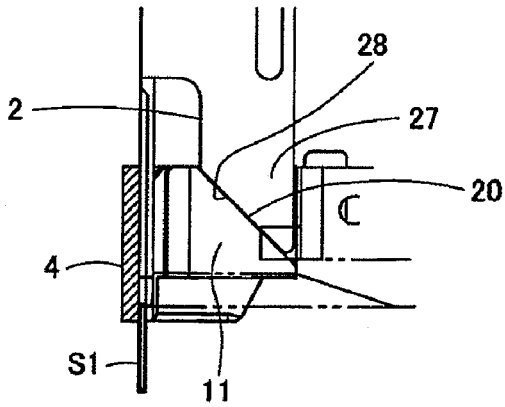

In the structure, when the forming plate 2 is moved downward to reach the bottom dead center in the formation so that the staple is formed into U-shape as shown in FIGS. 6 and 9, the both leg portions of the staple S are bent and are thus accommodated on an inside of the both side pieces 13 of the forming plate 2. As shown in FIGS. 3, 6 and 7, therefore, the staple S is pushed by the pusher 11 and is thus moved to the driving portion 15 provided in a forward part corresponding to a single staple (see FIG. 6). When the forming plate 2 is moved downward, the inclined surface 28 of the engaging piece 27 is engaged with the receiving portion 20 on the rear end of the pusher 11 as shown in FIGS. 5A, 5B and 10B via the notch portion 21 (see FIG. 4) of the staple guide presser 7.

In this state, the front surface of the head staple S1 is guided by the back face of the face plate 4, the both outer side surfaces of the staple are guided by the inner surfaces 17 of the both side pieces 13 in the forming plate 2, the both inner side surfaces are guided by the inside guide 31 (see FIG. 6), and furthermore, a rear surface of the head staple S1 is guided by a second staple and a front wall surface of the pusher 11 (see FIG. 7).

When the driver plate 1 is driven, next, a crown portion on the center of the head staple S1 is hit. Therefore, the head staple S1 is guided as described above and is thus driven out of the driving portion 15 toward the sheets (see FIGS. 3, 7 and 10B). The front parts and inner and outer side parts of the both leg portions 30 of the staple S1 are guided by a fixed surface and the rear parts thereof are guided by the pusher 11. The pusher 11 is usually energized simply by means of a spring. However, the forming plate 2 is moved downward so that the engaging piece 27 of the forming plate 2 is engaged with the receiving portion 20 of the pusher 11. Therefore, the pusher 11 cannot be moved backward any more (see FIGS. 5A, 5B and 10B). Even if the leg portion 30 of the staple S1 is inclined rearward so that a force acts to push down the pusher 11 rearward by a greater force than a spring force when the driver plate 1 drives the staple S1 out, therefore, the pusher 11 can be prevented from being moved backward by the engaging piece 27 (moved toward an opposite side to push-out). Consequently, the rear part of the head staple S1 can also be guided reliably. Accordingly, it is possible to satisfactorily prevent a drive-in failure from being caused.

The inclined surface 28 of the forming plate 2 and the receiving portion 20 of the pusher 11 to be engaged with the inclined surface 28 are inclined to each other. When the forming plate 2 is moved downward, therefore, a slope of the inclined surface 28 is reliably engaged with the back face of the pusher 11 irrespective of a slight error by a wedge effect. Consequently, it is possible to reliably prevent the pusher 11 from being moved toward the opposite side to the push-out.

It is not necessary to always incline both the engaging piece 27 of the forming plate 2 and the receiving portions 20 on the rear ends at the both sides of the pusher 11. Only one of them may be inclined.

EXPLANATION OF DESIGNATION

4 forming plate
5 driver plate
11 pusher
20 receiving portion
27 engaging piece

What is claimed is:

1. A stapler comprising:

a forming plate configured to form a straight staple into U-shape;

a pusher configured to push the formed U-shape staple in a first direction toward a driving portion;

a driver plate configured to drive the staple within the driving portion toward sheets of paper;

an engaging portion formed on the forming plate; and a receiving portion formed on the pusher, wherein the engaging portion is configured to engage with the receiving portion, during a driving operation of the driver plate, so as to prevent the pusher from moving in a second direction which is opposite to the first direction, the engaging portion includes a first inclined surface, the receiving portion includes a second inclined surface formed in the pusher at a side of the second direction, by engaging the first inclined surface with the second inclined surface, the pusher is prevented from moving to the second direction, the driver plate is movable in a third direction perpendicular to the first direction to drive the stapler toward the sheets, the second inclined surface comprises a flat surface inclined toward the third direction along the second direction, and the first inclined surface is parallel to the second inclined surface.

* * * * *